US007794063B2

(12) United States Patent
Kobayashi et al.

(10) Patent No.: US 7,794,063 B2
(45) Date of Patent: Sep. 14, 2010

(54) LIQUID-DROPLET JETTING HEAD AND LIQUID-DROPLET JETTING APPARATUS

(75) Inventors: Kazuo Kobayashi, Kakamigahara (JP); Hiroyuki Ishikawa, Nisshin (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 853 days.

(21) Appl. No.: 11/717,869

(22) Filed: Mar. 14, 2007

(65) Prior Publication Data

US 2007/0216735 A1 Sep. 20, 2007

(30) Foreign Application Priority Data

Mar. 15, 2006 (JP) ..... 2006-070264

(51) Int. Cl.
*B41J 2/045* (2006.01)
*B41J 2/14* (2006.01)

(52) U.S. Cl. ..... 347/71; 347/50

(58) Field of Classification Search ..... 347/10, 347/50, 58, 68–72; 310/316–318, 326
See application file for complete search history.

(56) References Cited

U.S. PATENT DOCUMENTS 7,026,744 B2 * 4/2006 Humpston et al. ..... 310/318

FOREIGN PATENT DOCUMENTS

| | | |
|---|---|---|
| JP | 61-139448 | 6/1986 |
| JP | 62-085953 | 4/1987 |
| JP | 9214012 | 8/1997 |

* cited by examiner

*Primary Examiner*—Stephen D Meier
*Assistant Examiner*—Geoffrey Mruk
(74) *Attorney, Agent, or Firm*—Eugene LeDonne; Joseph W. Treloar; Frommer Lawrence & Haug LLP

(57) ABSTRACT

An ink-jet head includes a channel unit which includes a plurality of pressure chambers, a vibration plate stacked on the channel unit, and a piezoelectric material layer arranged on the vibration plate. The piezoelectric material layer includes a first portion functioning as a piezoelectric actuator, and a second portion functioning as a piezoelectric transformer which amplifies a driving signal to be supplied to the piezoelectric actuator. Accordingly, it is possible to realize a small-size ink-jet head with a built-in piezoelectric amplifier.

23 Claims, 10 Drawing Sheets

LIQUID-DROPLET JETTING HEAD AND LIQUID-DROPLET JETTING APPARATUS

CROSS REFERENCE TO RELATED APPLICATION

The present application claims priority from Japanese Patent Application No. 2006-070264, filed on Mar. 15, 2006, the disclosure of which is incorporated herein by reference in its entirety.

BACKGROUND OF THE INVENTION

1. Field of the Invention

The present invention relates to a liquid droplet jetting head and a liquid droplet jetting apparatus.

2. Description of the Related Art

In hitherto available liquid droplet jetting heads such as an ink-jet head in which a piezoelectric actuator is used, a driving pulse (such as a driving waveform and a voltage signal) which drives the piezoelectric actuator is generated in a driver chip, and is directly supplied to the piezoelectric actuator which is provided corresponding to a pressure chamber of the ink-jet head.

Taking into consideration a cost aspect, a drive voltage is sought to be lowered. Whereas, since a deformation of the piezoelectric actuator closely depends on the drive voltage, when the drive voltage is lowered, it is not possible to deform the piezoelectric actuator substantially.

As a circuit which amplifies the drive voltage applied to a piezoelectric element provided to the ink-jet head, a piezoelectric transformer which has a simple structure and which is a small-size (thin) and incombustible, has hitherto been known (refer to Japanese Patent Application Laid-open No. S61-139448, and Japanese Patent Application Laid-open No. S62-85953 for example).

SUMMARY OF THE INVENTION

In a liquid droplet jetting head such as the ink-jet head described above, when the drive voltage is increased, it leads to a rise in a cost of the driver chip and a power supply. Moreover, providing a piezoelectric transformer as an amplifier for the drive voltage also leads to a rise in the cost.

An object of the present invention is to provide a liquid-droplet jetting head and a liquid droplet discharging apparatus which are capable of achieving a substantial actuator displacement (deformation) without leading to a rise in the cost.

According to a first aspect of the present invention, there is provided a liquid-droplet jetting head which is a liquid discharging head discharging a liquid, including a channel unit having a liquid chamber which stores the liquid, and a piezoelectric material layer which is arranged on the channel unit, and which includes a first portion which applies a pressure to the liquid stored in the liquid chamber when a predetermined voltage is applied to the first portion, and a second portion which amplifies the predetermined voltage which is to be applied to the first portion.

According to the first aspect of the present invention, since the piezoelectric material layer on an upper side of the channel unit includes the first portion which functions as a piezoelectric actuator corresponding to the liquid chamber (pressure chamber), and the second portion which functions as a piezoelectric transformer amplifying a drive voltage which is supplied to the piezoelectric actuator, by amplifying by the piezoelectric transformer the drive voltage to be supplied to the piezoelectric actuator, a substantial displacement (deformation) of the actuator is achieved without increasing the drive voltage by a driver for driving. Moreover, since the piezoelectric actuator (first portion) and the piezoelectric transformer (second portion) are arranged on the vibration plate, as a part of the piezoelectric material layer, a structure and a wiring are simplified, and it is possible to lower a manufacturing cost.

In the liquid-droplet jetting head of the present invention, the liquid droplet jetting head may be an ink-jet head which jets an ink, and further, may include a vibration plate which is arranged between the channel unit and the piezoelectric material layer, and the liquid chamber may include a plurality of pressure chambers. In this case, since the pressure chambers are covered by the vibration plate, the ink does not come in a direct contact with the piezoelectric material, and a durability of the ink-jet head is increased. Moreover, since there is a plurality of pressure chambers, it is possible to jet simultaneously a substantial amount of ink.

In the liquid-droplet jetting head of the present invention, the first portion may be a piezoelectric actuator and the second portion may be a piezoelectric transformer.

In this case, since the second portion is a piezoelectric transformer, a high-voltage signal for the piezoelectric actuator can be supplied by the piezoelectric transformer. Accordingly there is no need to provide a high-voltage power supply for driving the piezoelectric actuator.

In the liquid-droplet jetting head of the present invention, a slit or a groove which partitions the first portion and the second portion may be formed in the piezoelectric material layer.

In this case, since the first portion and the second portion are isolated by the slit or the groove, it is possible to prevent an operation of the first portion from affecting an operation of the second portion.

In the liquid-droplet jetting head of the present invention, the first portion and the second portion may be formed of a same piezoelectric material.

In this case, since the first portion and the second portion are formed by the same piezoelectric material, the manufacturing cost is reduced. The material of the first portion and the second portion being the same, temperature characteristics are the same, and a circuit such as a temperature compensated circuit is not required.

In the liquid-droplet jetting head of the present invention, a resonance frequency of the piezoelectric actuator may be lower than a resonance frequency of the piezoelectric transformer.

In this case, it is possible to use a signal in which an output from the second portion is integrated, and to reduce a size of the second portion by making the resonance frequency of the second portion to be higher than the resonance frequency of the first portion, and also the first portion can be controlled easily.

In the liquid-droplet jetting head of the present invention, a common electrode layer covering the first portion and the second portion may be formed on a surface of the piezoelectric material layer on a side of the channel unit, the common electrode layer being an electrode common for the piezoelectric actuator and for the piezoelectric transformer. The piezoelectric actuator may have an individual electrode formed, on a surface of the piezoelectric material layer on a side opposite to the channel unit, at an area corresponding to the first portion, and may have an input electrode and an output electrode formed at an area corresponding to the second portion. The liquid-droplet jetting head may further include a wire which connects the individual electrode and the output electrode.

In this case, since the input electrode and the output electrode of the piezoelectric transformer are formed in the area corresponding to the second portion, and since the wire which connects the individual electrode and the output electrode is provided, it is possible to form the piezoelectric transformer on the piezoelectric material layer on an upper side of the vibration plate, and to make an electrical wiring in a simple manner.

In the liquid-droplet jetting head of the present invention, the first portion may be polarized in a predetermined direction and the second portion may have a first sub-portion which is polarized in the predetermined direction and a second sub-portion which is polarized in a direction orthogonal to the predetermined direction.

In this case, since the second portion has two sub-portions polarized in mutually orthogonal directions, the second portion can be served as the piezoelectric transformer.

In the liquid-droplet jetting head of the present invention, the predetermined direction may be a thickness direction of the piezoelectric material layer, the first sub-portion may correspond to the input electrode, and a second sub-portion may correspond to the output electrode and may be polarized in an extending direction in which the piezoelectric material layer is extended.

In this case, the first portion is polarized in the direction of thickness (thickness direction) of the piezoelectric material layer, and functions as a piezoelectric actuator, the area of the second portion corresponding to the input electrode is polarized in the direction of thickness of the piezoelectric material layer, and the area of the second portion corresponding to the output electrode is polarized in the direction of extension of the piezoelectric material layer (extending direction), and the second portion functions as a piezoelectric transformer.

In the liquid-droplet jetting head of the present invention, the vibration plate may be electroconductive, and may also serve as the common electrode layer.

In this case, since the vibration plate is electroconductive, and also serves as the common electrode layer, it is possible to simplify a structure of the vibration plate.

In the liquid-droplet jetting head of the present invention, the second portion may include a plurality of transformer portions arranged in two parallel rows, and the first portion may include a plurality of actuator portions which correspond to the transformer portions respectively, and which are arranged on a side, of the transformer portions, opposite to the slit or the groove.

In this case, although the two rows of the transformer portions (piezoelectric transformers) are extended to be mutually parallel, since the slit or the groove is formed between the two rows, the adjacent transformer portions (piezoelectric transformers) do not have an effect mutually.

In the liquid-droplet jetting head of the present invention, the first portion may include a plurality of actuator portions arranged in two actuator-portion rows which are parallel to each other, and the second portion may include a plurality of transformer portions which correspond to the actuator portions respectively, and which are arranged in the piezoelectric material layer so that transformer portions, among the transformer portions, corresponding to actuator portions belonging to one of two actuator-portion rows, may be on a side opposite to transformer portions corresponding to actuator portions belonging to the other of the actuator-portion rows.

In this case, since the first portions (piezoelectric actuators) extended in two mutually parallel rows are arranged between the two second portions (piezoelectric transformers), the two adjacent second portions do not have an effect mutually.

In the liquid-droplet jetting head of the present invention, the second portion may include a stacked-layered piezoelectric transformer which has a plurality of stacked piezoelectric material layers.

In this case, it is possible to raise a gain (step-up ratio) according to the number of stacked layers.

In the liquid-droplet jetting head of the present invention, a recess may be formed in areas of the channel unit and the vibration plate respectively, each of the areas overlapping with the second portion. In this case, since a deformation of the second portion is not obstructed (not inhibited), it is possible to improve a performance as the piezoelectric transformer, and to increase a signal amplification factor of the second portion.

In the liquid-droplet jetting head of the present invention, the second portion may include a plurality of transformer portions arranged in a row, and a recess may be formed in areas, of the second portion, between two transformer portions among the transformer portions. In this case, it is possible to suppress a propagation of vibrations between the transformer portions belonging to the same row in the transformer portions arranged in a row, and to improve the performance of the transformer portion as a piezoelectric transformer.

In the liquid-droplet jetting head of the present invention, the extending direction may be a direction along a straight line which connects the input electrode and the output electrode of the second portion. In this case, it is possible to polarize easily in the direction along the straight line which connects the input electrode and the output electrode by applying a voltage between the input electrode and the output electrode.

In the liquid-droplet jetting head of the present invention, the first portion may be arranged above the liquid chamber. In this case, the first portion is arranged above the liquid chamber, the first portion can apply a jetting pressure assuredly to the liquid in the liquid chamber.

According to a second aspect of the present invention, there is provided a liquid-droplet jetting apparatus which jets a droplet of a liquid onto an object, including a head which includes a channel unit and a piezoelectric material layer, the channel unit including a liquid chamber which stores the liquid, the piezoelectric material layer arranged on the channel unit and including a first portion which applies a pressure to the liquid stored in the liquid chamber when a predetermined signal is applied to the first portion, and a second portion which amplifies the predetermined signal which is to be applied to the first portion, a signal supplying unit which supplies the predetermined signal, and a transporting mechanism which transports the object in a predetermined direction.

According to the second aspect of the present invention, since the piezoelectric material layer on an upper side of the channel unit includes the first portion which functions as a piezoelectric actuator corresponding to each pressure chamber, and the second portion which functions as a piezoelectric transformer amplifying a driving signal which is to be supplied to the piezoelectric actuator, by amplifying by the piezoelectric transformer the drive voltage supplied to the piezoelectric actuator, it is possible to achieve a substantial deformation of the actuator, without spending more on the manufacturing cost.

As it has been described above, inventors of the invention in the present patent application, rather than only using the piezoelectric transformer described in Japanese Patent Application Laid-open No. S 61-13948 and Japanese Patent Application Laid-open No. S 62-85953, directed their attention to a point that both a piezoelectric actuator of the liquid-droplet jetting head such as an ink-jet head, and a piezoelectric transformer which amplifies the drive voltage use a piezoelectric layer, and have been successful in making the present invention based on a new conclusion of using the piezoelectric layer formed on the vibration plate for both the piezoelectric actuator and the piezoelectric transformer.

DETAILED DESCRIPTION OF THE PREFERRED EMBODIMENTS

An embodiment of the present invention will be described below with reference to the diagrams.

Figure 1A:
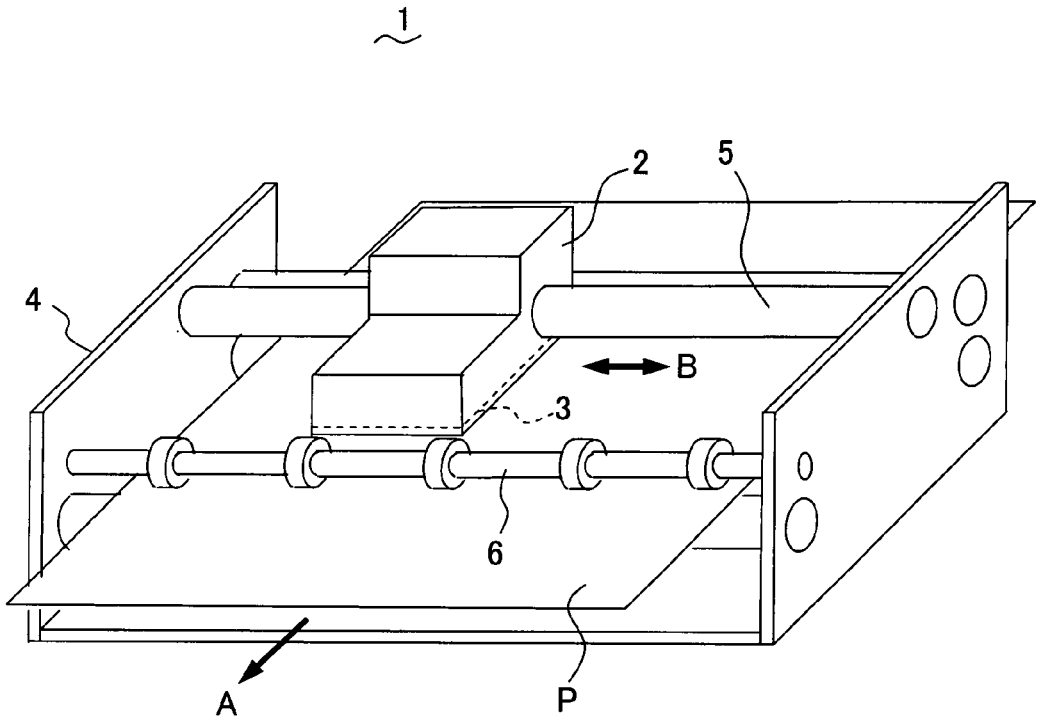
FIG. 1A is a schematic structural diagram showing a schematic structure of an ink-jet printer according to the present invention.
Figure 1B:
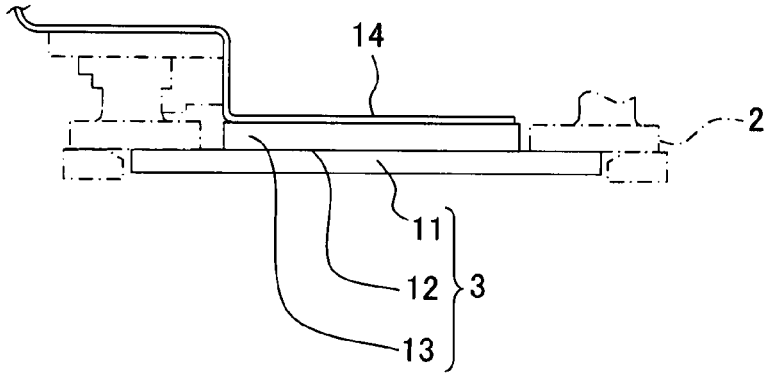
FIG. 1B is a diagram showing a relationship among a channel unit, a piezoelectric material layer, and a flexible flat cable.

FIG. 1A is a schematic structural view showing a schematic structure of an ink-jet printer according to the present invention, and FIG. 1B is a diagram showing a relationship between a piezoelectric material layer and a flexible flat cable.

As shown in FIG. 1A, an ink-jet printer as an example of a liquid-droplet jetting apparatus according to the present invention is provided with an ink-jet head 3 on a lower surface of a carriage 2 on which an ink cartridge (not shown) is mounted, which records an image on to a recording paper P (recording medium). The carriage 2 is supported by a guide plate (not shown) and a carriage shaft 5 provided in a printer frame 4, and reciprocates in a direction (direction B in FIG. 1A) which is orthogonal to a direction of transporting of the recording paper P (direction A in FIG. 1A).

The recording paper P which is carried in the direction A from a paper feeding section (not shown), is fed between a platen roller (not shown) and the ink-jet head 3. A predetermined image is recorded by an ink jetted from the ink-jet head 3 toward the recording paper P, and then the recording paper P is discharged by a paper discharging roller 6.

Moreover, the ink-jet head 3 includes a channel unit 11, a vibration plate 12 which is stacked on the channel unit 11, a piezoelectric material layer 13 which is formed on the vibration plate 12, and a flexible cable (signal wire, FPC) 14 which transmits a driving signal and is provided on the piezoelectric material layer 13.

A plurality of nozzles 22*a*, a plurality of pressure chambers 23*a*, and a manifold 25*a* which temporarily stores an ink to be supplied to the pressure chambers 23*a* are formed in the channel unit 11. The piezoelectric material layer 13 has an individual surface electrode 31 facing the pressure chamber 23*a*. As it will be described later, a volume of the pressure chamber 23*a* is changed by supplying a driving signal to the individual surface electrode 31, and the ink is discharged from the nozzle 22*a*.

Figure 2:
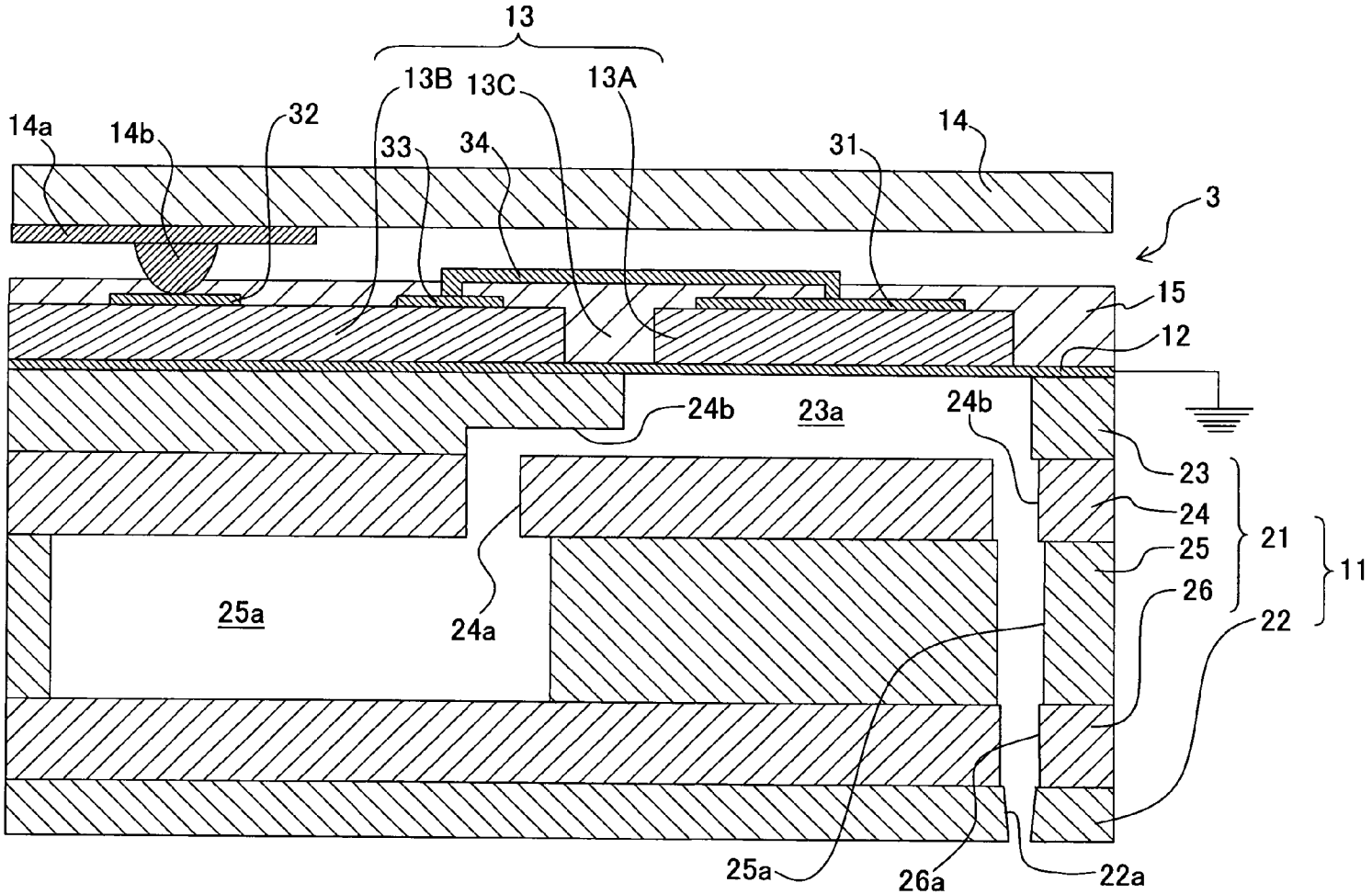
FIG. 2 is a cross-sectional view taken along a line II-II shown in FIG. 1.

As shown in FIG. 2, the channel unit 11 includes a stacked structure 21 in which a plurality of plates is stacked, and a nozzle plate 22 which is joined to a lower side of the stacked structure 21. The stacked structure 21 is a structure in which, a cavity plate 23, a base plate 24, a manifold plate 25, and a spacer plate 26 are stacked in this order from an upper side, and these plates are joined by metal diffusion joining. The plates 23 to 26 are aligned and stacked so as to form individual ink channels corresponding to nozzles 22*a* formed in the nozzle plate 22.

The cavity plate 23 is a metallic plate in which a plurality of through holes, each having an opening of elongated shape and arranged at regular intervals, are provided. These through holes function as the pressure chambers 23*a*.

The base plate 24 is a metallic plate in which a communicating hole 24*a* which communicates a manifold 25*a* with the pressure chamber 23*a*, and a communicating hole 24*b* which communicates the pressure chamber 23*a* with the nozzle 22*a*, are provided. A connecting groove 23*b* which connects the pressure chamber 23*a* and the communicating hole 24*a* is formed in a lower surface side of the cavity plate 23.

The manifold plate 25 is a metallic plate in which, the manifold 25*a*, and communicating holes 25*a* which communicate the pressure chamber 23*a* with the nozzles 22*a* are provided. The spacer plate 26 is a metallic plate in which the communicating holes 26*a* corresponding to the nozzles 22*a* are formed.

Moreover, the nozzle plate 22 is a synthetic resin (such as polyimide) plate in which, the nozzles 22*a* corresponding to the pressure chambers 23*a* formed in the cavity plate 23 are provided. Since the manifold plate 25 is thicker than the other plates 23, 24, and 26, it may be formed by sticking two plates. The nozzle plate 22 may be a metallic plate.

The piezoelectric material layer 13 includes a plurality of first portions 13A which function as a piezoelectric actuator corresponding to pressure chambers 23*a* respectively, and a plurality of second portions 13B arranged along the first portions 13A, which function as a piezoelectric transformer which amplifies a driving signal to be supplied to the piezoelectric actuator. The first portion 13A and the second portion 13B are formed of the same piezoelectric material (for example, a piezoelectric material based on a lead zirconate titanate ceramics (PZT) which is a ferroelectric substance). A groove 13C is provided between the first portion 13A and the second portion 13B. The first portion 13A and the second portion 13B are isolated by the groove 13C such that the first portion 13A and the second portion 13B have no effect mutually.

The vibration plate 12 which is provided on a lower side of the piezoelectric material layer 13, in other words on a surface of the piezoelectric material layer 4, toward the channel unit 2, is electroconductive and also serves as an internal common electrode layer. In other words, the vibration plate 12 is arranged to cover the first portion 13A and the second portion 13B, and functions as a common electrode layer which is an electrode in common for the piezoelectric actuator and the piezoelectric transformer.

An individual surface electrode 31 of the piezoelectric actuator is formed in an area on an upper surface of the piezoelectric material layer 13 (surface of the piezoelectric material layer 4 on a side opposite to the channel unit 2), facing the first portion 13A, and an input electrode 32 and an output electrode 33 of the piezoelectric transformer are formed in an area on the upper surface of the piezoelectric material layer 13, facing the second portion 13B. The individual surface electrode 31 is provided corresponding to each pressure chamber 23*a*.

Figure 3:
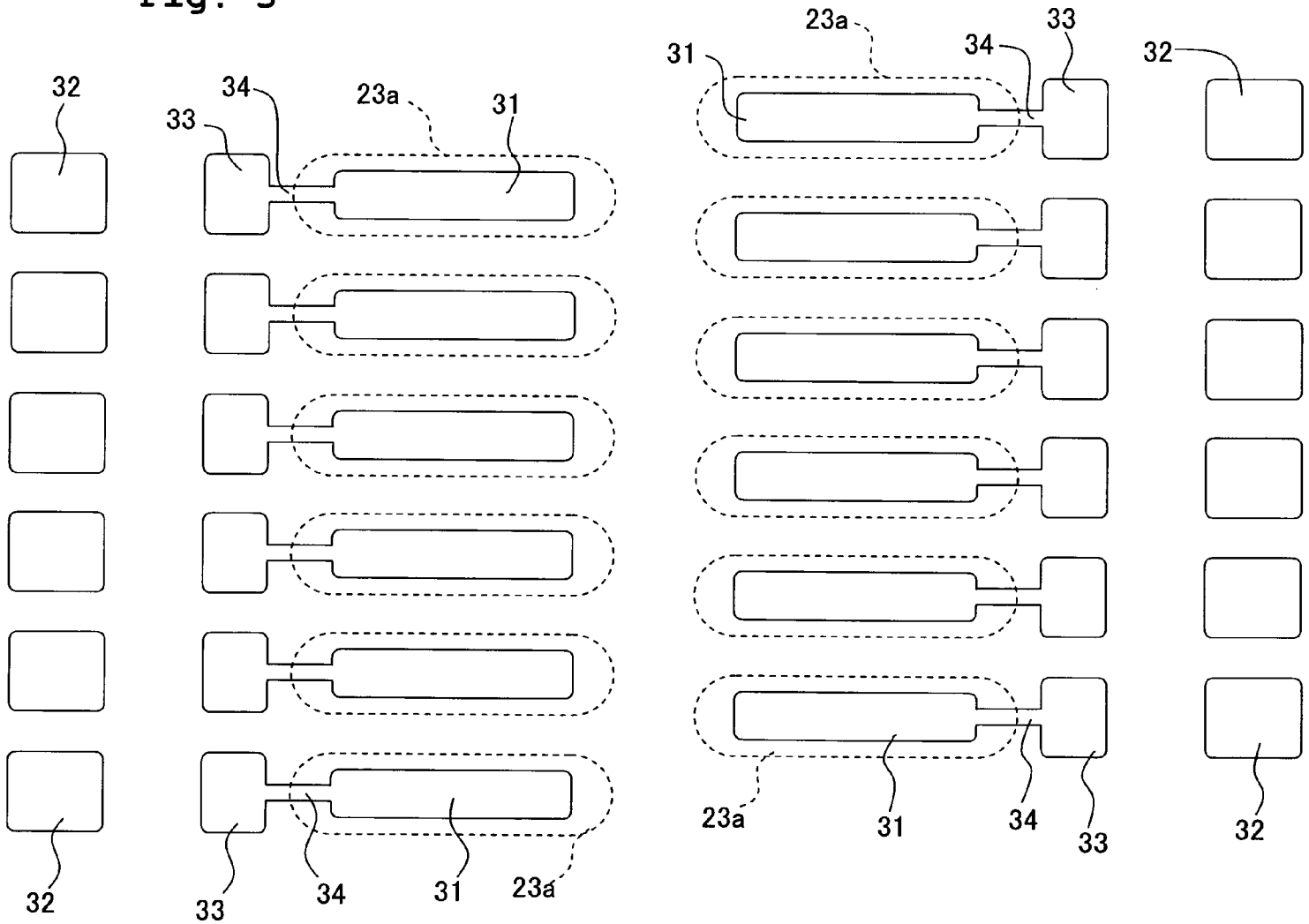
FIG. 3 is a schematic structural diagram showing an arrangement of electrodes on the piezoelectric material layer in an ink-jet head which is an embodiment of the present invention.

As shown in FIG. 3, the pressure chambers 23*a* are arranged in two rows in a staggered form along a longitudinal direction of the cavity plate 23 (right and left direction in FIG. 2). The individual surface electrodes 31 corresponding to the pressure chambers 23*a* respectively (corresponding to the first portion 13A) are also arranged in a staggered form in two rows. Moreover, the input electrodes 32 and the output electrodes 33 (corresponding to the second portion 13B) are arranged next to the individual surface electrodes 31 respectively, on a side opposite to other individual surface electrodes 31 in an adjacent row. As shown in FIG. 2, the piezoelectric material layer 13 and each of the electrodes 31 to 33 (individual surface electrode 31, the input electrode 32, and the output electrode 33) are covered by a protective film 15. The protective film 15 is formed of an insulating material such as a silicon resin and an epoxy resin, and protects the piezoelectric material layer 13 and the electrodes 31 to 33.

A wire 34 extending along a longitudinal direction of the pressure chamber 23*a* is formed on an upper surface of the protective layer 15, and the individual surface electrode 31 and the output electrode 33 are connected by the wire 34. Moreover, the individual surface electrode 31, the input electrode 32, and the output electrode 33 are made of a metallic material such as Ag—Pd. As shown in FIG. 2, a driving signal from a driver IC which is not shown in the diagram is supplied to the input electrode 32 via a connecting terminal portion 14*b* of the flexible flat cable 14 (signal line 14*a*).

Figure 4:
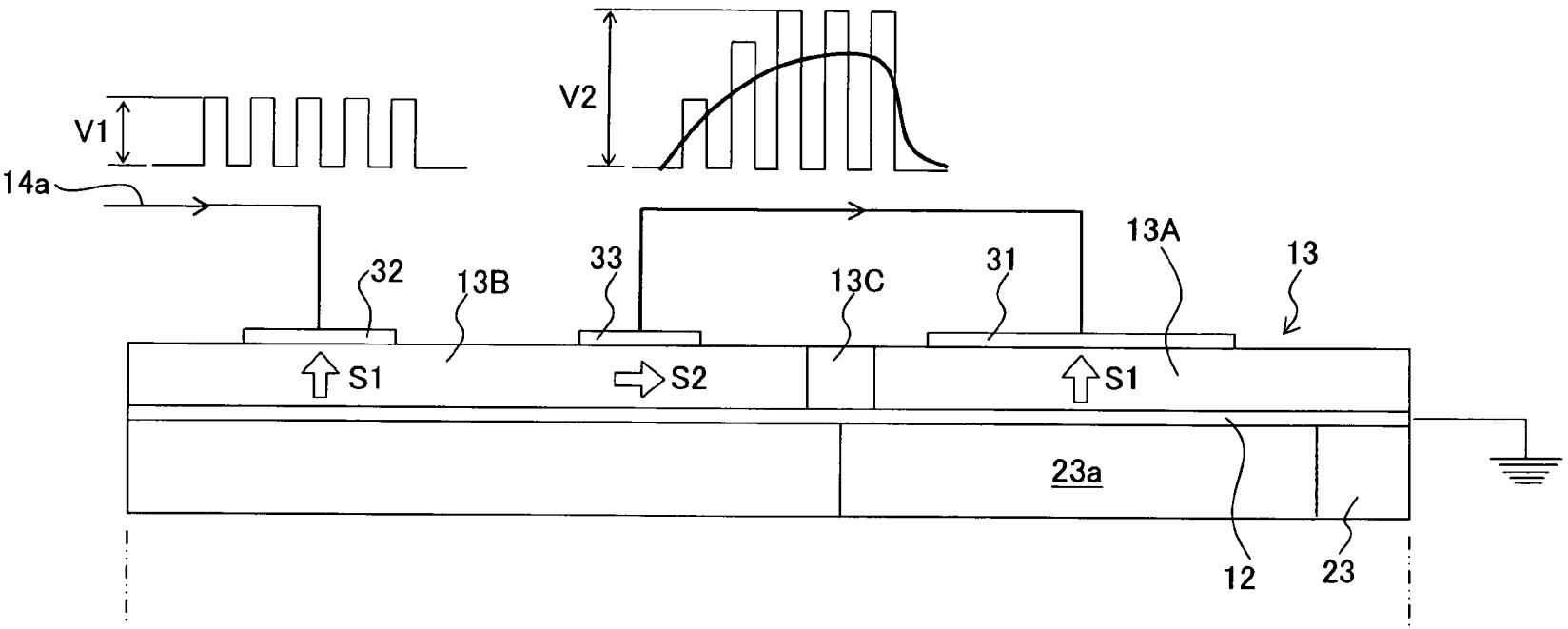
FIG. 4 is a diagram of a direction of polarization in a first portion and a second portion.

As shown in FIG. 4, the first portion 13A (portion corresponding to the individual surface electrode 31) of the piezoelectric material layer 13 is polarized in a thickness direction S1 of the piezoelectric material layer 13, and the vibration plate (common electrode) 12 is kept all the time at a ground electric potential. An area of the second portion 13B, corresponding to the input electrode 32 (first sub-portion) is polarized in the thickness direction S1 of the piezoelectric material layer 13, and an area of the second portion corresponding to the output electrode 33 (second sub-portion) is polarized in an extending direction S2 (longitudinal direction, direction along a line connecting the input electrode 32 and the output electrode 33) of the second portion 13B.

A resonance frequency of the piezoelectric actuator (for example 20 kHz) is set to be lower than a resonance frequency of the piezoelectric transformer (for example 2 MHz) in order to prevent the second portion 13B (transformer portion) which functions as a piezoelectric transformer from affecting the first portion 13A (actuator portion) which functions as a piezoelectric actuator. Here, the resonance frequency of the piezoelectric actuator depends on dimensions of the piezoelectric actuator such as a width, a length, and a thickness, and on a stiffness of the piezoelectric actuator, and the resonance frequency of the piezoelectric transformers depends on a ratio of lengths in two directions of polarization in addition to the dimensions of the piezoelectric transformer such as a width, a length, a thickness, and, the stiffness. The piezoelectric actuator can be driven by an integrated output from the piezoelectric transformer as described below.

When a drive voltage V1 (for example 5 V) is input to the input electrode 32 through the flexible flat cable 14 (signal wire 14*a*), since the area corresponding to the input electrode 32 is polarized in the thickness direction S1 of the piezoelectric material layer 13, the second portion 13B is elongated in the thickness direction S1, and is contracted in a direction orthogonal to the thickness direction S1 (for example an extending direction S2), due to an inverse piezoelectric effect. When the drive voltage V1 is applied at a frequency close to the resonance frequency of the piezoelectric transformer, since the deformation mentioned above is repeated at a frequency close to the resonance frequency, the second portion 13B is resonated, and strong vibrations (vibrations of substantial amplitude) are generated. At this time, due to the vibrations generated in the extending direction S2, a high voltage V2 (for example 20 V) in accordance with the amplitude of vibrations is output from the output electrode 33 (piezoelectric effect). In this manner, in the second portion 13B, the drive voltage applied to the input electrode 32 is amplified, and output to the output electrode 33. In other words, by using the second portion 13B as a piezoelectric transformer, it is possible to generate a high voltage with a low voltage input by using a resonance phenomenon of the piezoelectric vibrator (the piezoelectric resonator). As shown in FIG. 4, when a rectangular wave signal is input to the input electrode 32 at a predetermined frequency, a rectangular wave signal having gradually increased amplitude is output from the output electrode 33. When this is connected to the individual surface electrode 31 of the first portion 13A, a signal as shown by a solid line, having a waveform in which an output signal from the output electrode 33 is integrated is input to the individual surface electrode 31.

In this manner, an electric signal of the high voltage (V2) which is output from the output electrode 33 is input to the individual surface electrode 31 through the wire 34. Since an electric potential of the individual surface electrode 31 becomes higher than the ground electric potential, an electric field is applied in the direction of polarization of the piezoelectric material layer 13. The piezoelectric material layer 13 to which the electric field is applied is contracted as an active layer in a direction orthogonal to the direction of polarization (orthogonal direction) due to a piezoelectric transverse effect. On the other hand, the vibration plate 12 is not contracted spontaneously, as it does not have an effect of the electric field. Consequently, there is a difference in a distortion in the orthogonal direction, between the piezoelectric material layer 13 and the vibration plate 12 at the lower layer thereof. Since a lower surface of the vibration plate 12 is fixed to the cavity plate 23, the piezoelectric material layer 13 and the vibration plate 12 are deformed (unimorph deformation) to form a projection toward the pressure chamber 23*a*. Therefore, a volume of the pressure chamber 23*a* is decreased, and a pressure on the ink in the pressure chamber 23*a* is increased, and the ink is discharged from the nozzle 22*a*. After discharging of the ink, when the individual surface electrode 31 is returned to an electric potential same as of an electric potential of the internal common electrode (vibration plate 12), the piezoelectric material layer 13 and the vibration plate 12 regain the original shape (form), and the volume of the pressure chamber 23*a* returns to the original volume. Therefore, the ink is sucked from the manifold 25*a*, and a similar operation of ink discharge is repeated.

As it has been mentioned above, in this embodiment, since the vibration plate 12 is provided on the upper side of the channel unit 11, it is possible to let the piezoelectric actuator undergo the unimorph deformation, and to realize a very high discharge efficiency.

The channel unit 11 includes a plurality of nozzles 22*a*, a plurality of pressure chambers 23*a* which communicate with the nozzles, and a manifold 25*a* which temporarily stores an ink to be supplied to the pressure chambers 23*a*. On the other hand, the piezoelectric material layer 13 has individual surface electrodes 31 corresponding to the pressure chambers 23*a* respectively. As it will be described later, by supplying a driving signal to the individual surface electrode 31, a volume of the pressure chamber 23*a* is changed, and the ink is discharged from the nozzle 22*a*.

Figure 5:
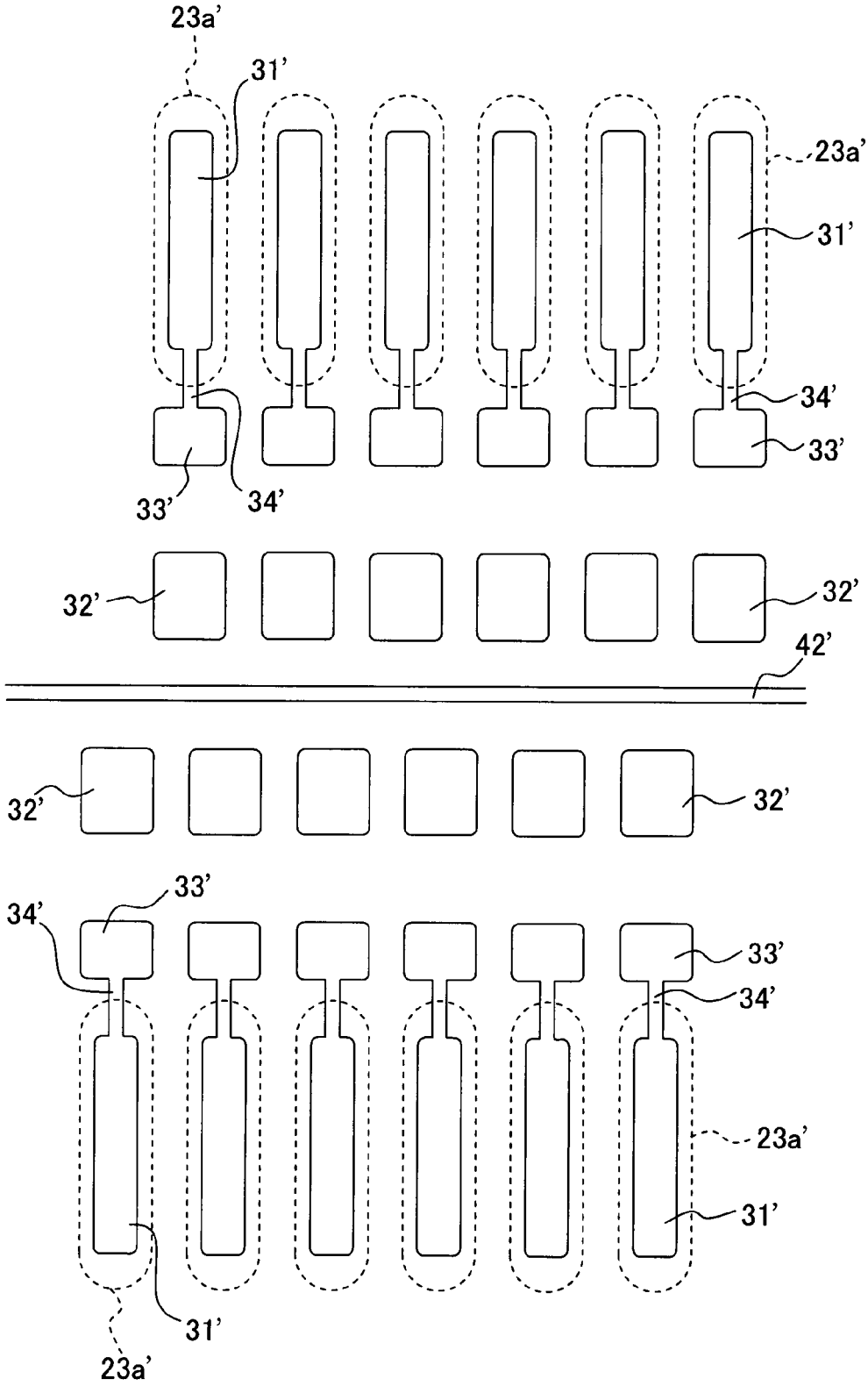
FIG. 5 is a diagram corresponding to FIG. 3, of an ink-jet head having a groove (or a slit)
Figure 6:
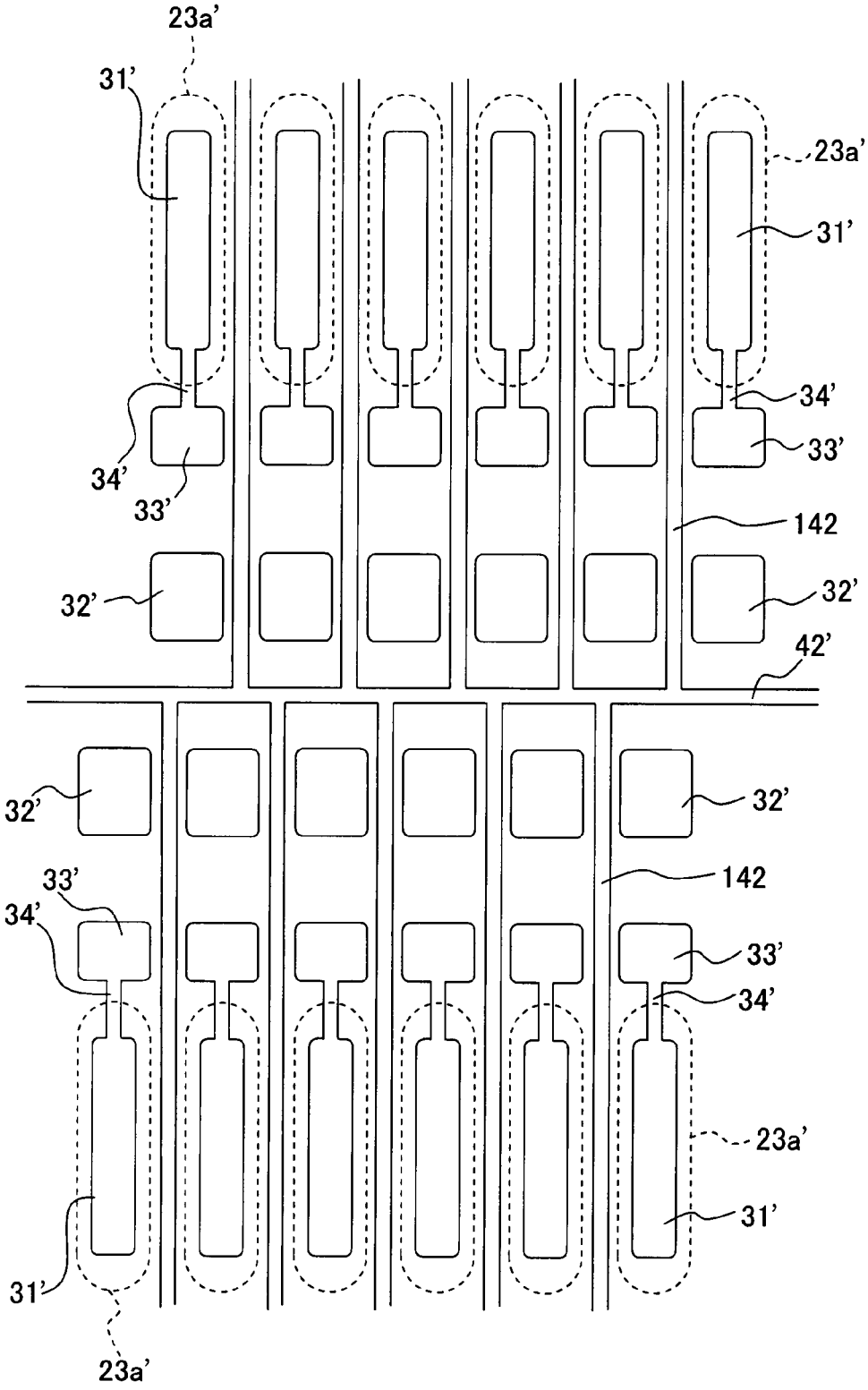
FIG. 6 is a diagram corresponding to FIG. 3, of an ink-jet head having the groove (or the slit)

It is also possible to modify the present invention as described below. For example, in the embodiment, the individual surface electrodes 31 (corresponding to the first portion 13A) corresponding to the pressure chambers 23*a* respectively form two mutually parallel adjacent rows. However, the present invention is not restricted to such a structure, and it is also possible to arrange the individual surface electrodes 31 as shown in FIG. 5 for example. In this case, two electrode rows are arranged in parallel sandwiching a groove 42 (or a slit), and each of the electrode rows includes a plurality of input electrodes 32' and output electrodes 33' (corresponding to the second portion 13B). Here, individual surface electrodes 31' (corresponding to the first portion 13A), which are connected by a wire 34' and which correspond to the input electrodes 32' and the output electrodes 33', are arranged on a side opposite to the groove 42. Here, it is possible to prevent the piezoelectric transformers arranged adjacently from having a mutual effect by providing the groove 42 between the two electrode rows. Furthermore, a groove 142 extended in a direction orthogonal (direction of a line) to a direction in which the electrode row is extended (direction of the row) may be formed instead of the groove 42, or in addition to the groove 42. For example, as shown in FIG. 6, the input electrodes 32' and the output electrodes 33' (corresponding to the second portion 13B) mutually adjacent in the direction of row may be separated (isolated) by the groove 142. In this case, it is possible to prevent the mutually adjacent piezoelectric transformers in the direction of row from having an effect mutually.

Figure 7:
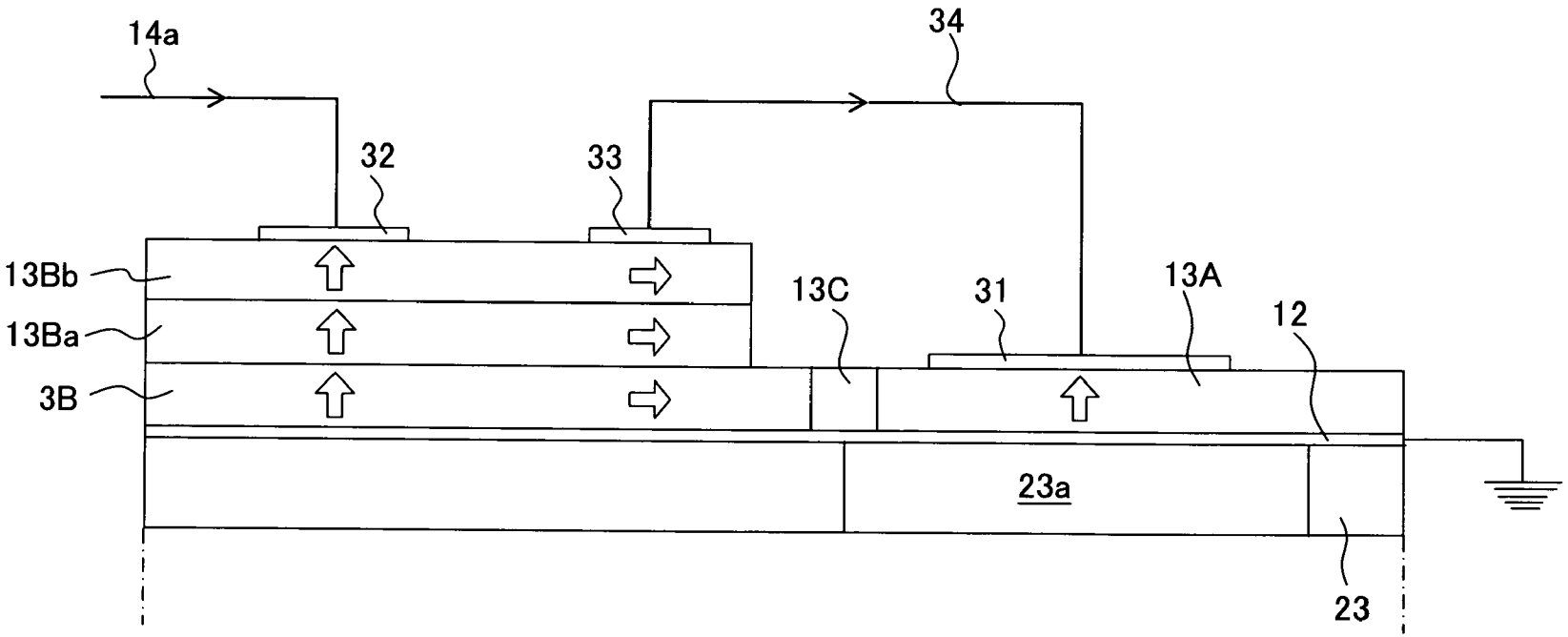
FIG. 7 is a diagram corresponding to FIG. 4, of an ink-jet head having a piezoelectric material layer having stacked layers.
Figure 8:
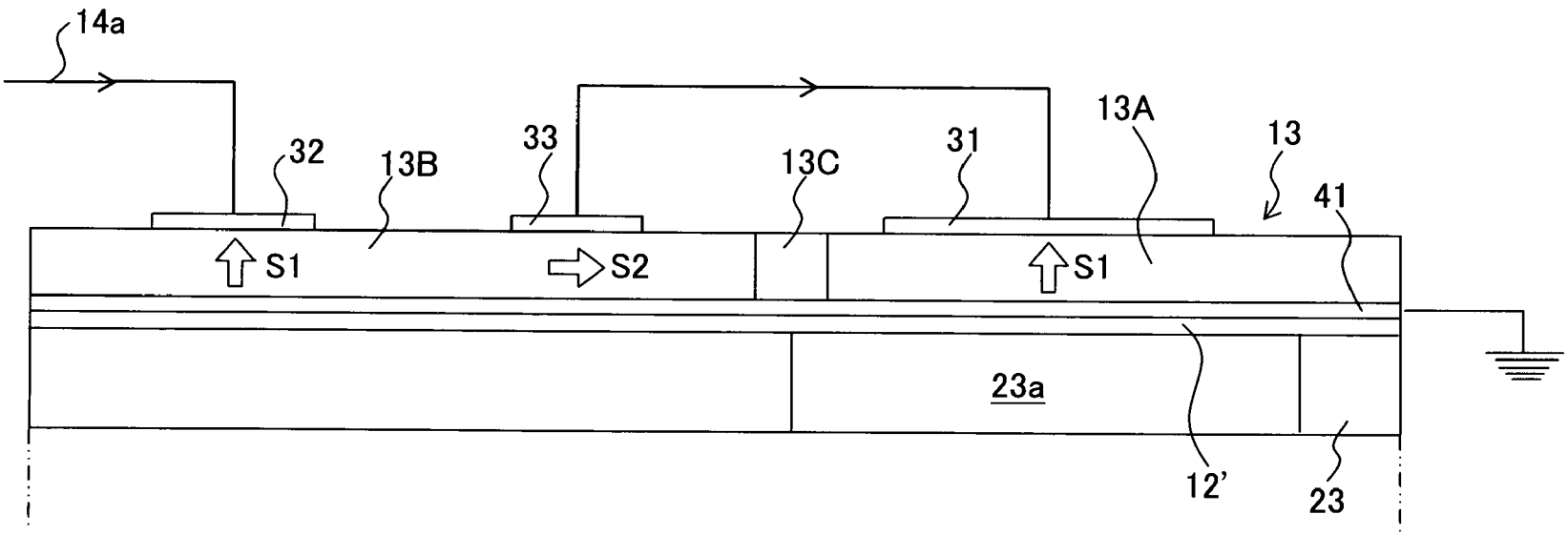
FIG. 8 is a diagram corresponding to FIG. 4, of an ink-jet head having a vibration plate made of an insulating substance (material)
Figure 9:
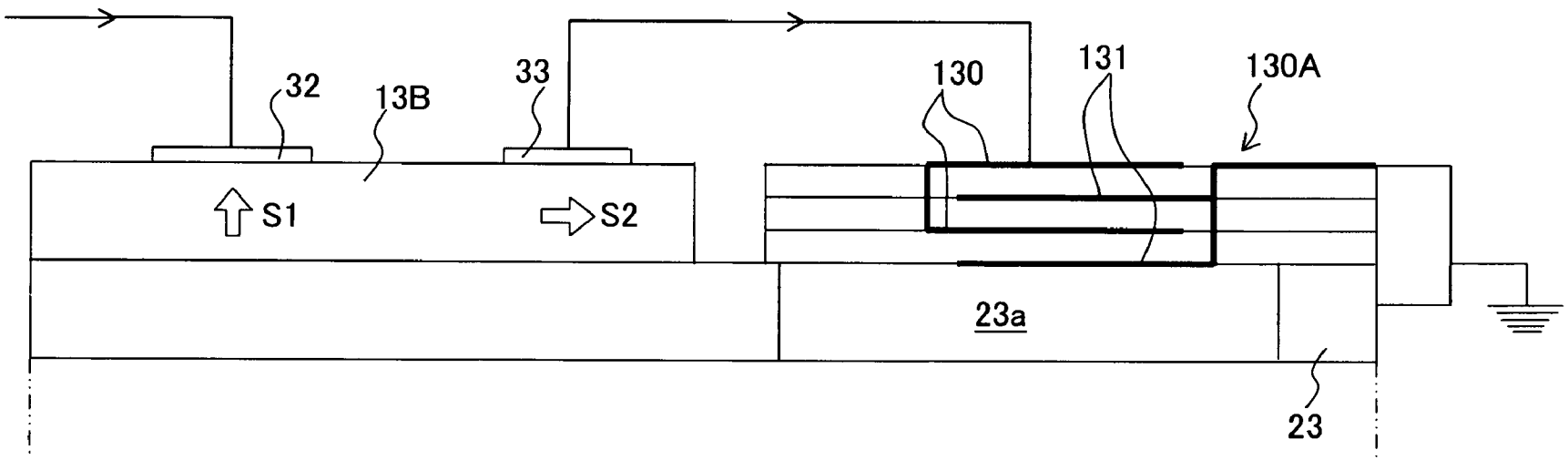
FIG. 9 is a diagram corresponding to FIG. 3, of an ink-jet head without a vibration plate.

In the embodiment described above, the second portion 13B has a single-layer structure similarly to the first portion 13A. However, as shown in FIG. 7, the second portion 13B may be formed as a stacked piezoelectric transformer in which a plurality of piezoelectric material layers 13Ba and 13Bb are stacked on the second portion 13B. When the structure is formed in such manner, it is possible to raise (improve) the gain in accordance with the number of stacked layers. Moreover, in the embodiment described above, the vibration plate 12 is used as a common electrode layer. However, the present invention is not restricted to such structure, and it is also possible to have a structure as shown in FIG. 8, in which a common electrode layer 41 is provided on an upper side of a vibration plate 12' which is made of an insulating material such as a synthetic resin, and the vibration plate 12' and the common electrode layer 41 are let to be separate. As shown in FIG. 9, without providing the vibration plate, the pressure chambers 23*a* may be covered directly by the first portion 13A. In this case, the first portion 13A may be formed as multiple layers as shown in FIG. 9. The individual electrodes 130 and common electrodes 131 are stacked alternately among the layers. In this case, the second portion 13B may be used as common electrodes by keeping the cavity plate at the ground potential.

Figure 10:
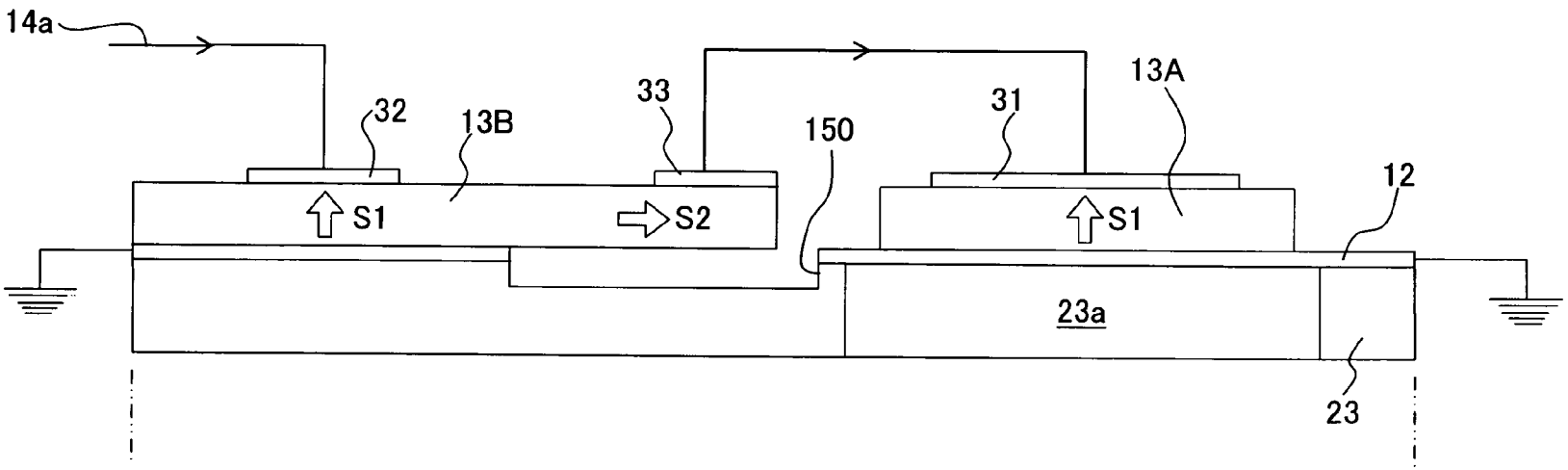
FIG. 10 is a diagram corresponding to FIG. 4, of an ink-jet head having a recess formed in the vibration plate and a cavity plate.

The second portion 13B is not required to be in contact with the vibration plate 12 throughout an entire lower surface, and as shown in FIG. 10, a recess 150 may be formed in area of the vibration plate 12 and the cavity plate 23, including an area overlapping with the output electrode 33. An ink-jet head 103 shown in FIG. 10 has a structure similar to the structure of the ink-jet head 3 according to the embodiment, except for a point that the recess 103 is formed in the vibration plate 12 and the cavity plate 23. In the ink-jet head 103, the area of the second portion 13B, overlapping with the recess 150 is polarized in the extending direction S2. As it has been mentioned above, a high voltage is generated in the output electrode 33 due to the deformation of this area. When the recess 150 is formed in the ink-jet head 103, the area of the second portion 13B overlapping with the recess 150 is connected to a vibration plate and/or a cavity plate. Consequently, the deformation of this area is not obstructed (inhibited), and it is possible to have a substantial deformation. Therefore, it is possible to achieve a high-voltage output. Moreover, as shown in FIG. 10, the output electrode 33 may be formed at a position away from the input electrode 32. When the second portion 13B is polarized in the direction of extension S2 by applying a predetermined high voltage between the input electrode 32 and the output electrode 33, it is possible to elongate the area of the second portion 13B polarized in the direction S2 by making an interval between the input electrodes longer. Therefore, it is possible to raise (improve) the gain of the piezoelectric transformer, and to make high the voltage generated in the output electrode 33. Moreover, in the ink-jet head 103, since the recess 150 is formed in a portion of the vibration plate 12 functioning as the common electrode, facing the output electrode 33, a distance between the output electrode 33 and the common electrode becomes longer, and an electrostatic capacitance between the output electrode 33 and the common electrode is decreased. Therefore, it is possible to make high the voltage generated in the output electrode 33. Moreover, the recess 150 may be formed only in the vibration plate 12.

In the embodiment described above, the first portion 13A and the second portion 13B of the piezoelectric material layer 13 are formed of the same piezoelectric material so that it is advantageous from manufacturing point of view. However, the present invention is not restricted to such arrangement, and it is also possible to form the first portion 13A and the second portion 13B of different piezoelectric materials. Moreover, the number and arrangement of the first portion 13A and the second portion 13B may be arbitrary. An arrangement and shape of the input electrode 32 and the output electrode 33 in the second portion are not restricted to the arrangement and shape in the embodiment. The first portion and the first sub-portion of the second portion may be polarized in a direction slightly different from the thickness direction. The second sub-portion of the second portion may be polarized in an orthogonal direction which is substantially orthogonal to the direction in which the first portion is polarized. The number of the pressure chambers included in the channel unit may also be set arbitrarily. Furthermore, in the embodiment described above, an ink-jet head which jets the ink is described. However, the liquid droplet jetting head of the present invention is not restricted to the ink-jet head, and may be a liquid droplet jetting head which jets a liquid other than the ink, such as a reagent, a biomedical solution, a wiring material solution, an electronic material solution, a liquid for a cooling medium, and a liquid fuel.

What is claimed is:

1. A liquid-droplet jetting head which jets a droplet of a liquid, comprising:

a channel unit having a liquid chamber which stores the liquid; and a piezoelectric material layer which is arranged on the channel unit, and which includes a first portion applying a pressure to the liquid stored in the liquid chamber when a predetermined voltage is applied to the first portion, and a second portion amplifying the predetermined voltage which is to be applied to the first portion.

2. The liquid-droplet jetting head according to claim 1, which is an ink-jet head jetting an ink, and which further includes a vibration plate arranged between the channel unit and the piezoelectric material layer, wherein the liquid chamber includes a plurality of pressure chambers.

3. The liquid-droplet jetting head according to claim 2, wherein the first portion is a piezoelectric actuator and the second portion is a piezoelectric transformer.

4. The liquid-droplet jetting head according to claim 2, wherein a slit which partitions the first portion and the second portion from each other is formed in the piezoelectric material layer.

5. The liquid-droplet jetting head according to claim 2, wherein a groove which partitions the first portion and the second portion from each other is formed in the piezoelectric material layer.

6. The liquid-droplet jetting head according to claim 2, wherein the first portion and the second portion are formed of a same piezoelectric material.

7. The liquid-droplet jetting head according to claim 3, wherein a resonance frequency of the piezoelectric actuator is lower than a resonance frequency of the piezoelectric transformer.

8. The liquid-droplet jetting head according to claim 3, wherein a common electrode layer covering the first portion and the second portion is formed on a surface of the piezoelectric material layer on a side of the channel unit, the common electrode layer being an electrode common for the piezoelectric actuator and for the piezoelectric transformer;

the piezoelectric actuator has an individual electrode formed, on a surface of the piezoelectric material layer on a side opposite to the channel unit, at an area corresponding to the first portion, and has an input electrode and an output electrode formed at an area corresponding to the second portion; and the liquid-droplet jetting head further includes a wire which connects the individual electrode and the output electrode.

9. The liquid-droplet jetting head according to claim 8, wherein the first portion is polarized in a predetermined direction and the second portion has a first sub-portion which is polarized in the predetermined direction and a second sub-portion which is polarized in a direction orthogonal to the predetermined direction.

10. The liquid-droplet jetting head according to claim 9, wherein the predetermined direction is a thickness direction of the piezoelectric material layer; the first sub-portion corresponds to the input electrode; and a second sub-portion corresponds to the output electrode and is polarized in an extending direction in which the piezoelectric material layer is extended.

11. The liquid-droplet jetting head according to claim 8, wherein the vibration plate is electroconductive and is the common electrode layer.

12. The liquid-droplet jetting head according to claim 4, wherein the second portion includes a plurality of transformer portions arranged in two parallel rows, and the first portion includes a plurality of actuator portions which correspond to the transformer portions respectively, and which are arranged on a side, of the transformer portions, opposite to the slit.

13. The liquid-droplet jetting head according to claim 5, wherein the second portion includes a plurality of transformer portions arranged in two parallel rows, and the first portion includes a plurality of actuator portions which correspond to the transformer portions respectively, and which are arranged on a side, of the transformer portions, opposite to the groove.

14. The liquid-droplet jetting head according to claim 2, wherein the first portion includes a plurality of actuator portions arranged in two actuator-portion rows which are parallel to each other, and the second portion includes a plurality of transformer portions which correspond to the actuator portions respectively, and which are arranged in the piezoelectric material layer so that transformer portions, among the transformer portions, corresponding to actuator portions belonging to one of two actuator-portion rows, are on a side opposite to transformer portions corresponding to actuator portions belonging to the other of the actuator-portion rows.

15. The liquid-droplet jetting head according to claim 2, wherein the second portion includes a stacked-layered piezoelectric transformer which has a plurality of stacked piezoelectric material layers.

16. The liquid-droplet jetting head according to claim 2, wherein a recess is formed in areas of the channel unit and the vibration plate respectively, each of the areas overlapping with the second portion.

17. The liquid-droplet jetting head according to claim 1, wherein the second portion includes a plurality of transformer portions arranged in a row, and a recess is formed in areas, of the second portion, between two transformer portions among the transformer portions.

18. The liquid-droplet jetting head according to claim 10, wherein the extending direction is a direction along a straight line which connects the input electrode and the output electrode of the second portion.

19. The liquid-droplet jetting head according to claim 1, wherein the first portion is arranged above the liquid chamber.

20. A liquid-droplet jetting apparatus which jets a droplet of a liquid onto an object, comprising:

a head which includes a channel unit and a piezoelectric material layer, the channel unit including a liquid chamber which stores the liquid, the piezoelectric material layer arranged on the channel unit and including a first portion which applies a pressure to the liquid stored in the liquid chamber when a predetermined signal is applied to the first portion, and a second portion which amplifies the predetermined signal which is to be applied to the first portion;

a signal supplying unit which supplies the predetermined signal; and a transporting mechanism which transports the object in a predetermined direction.

21. The liquid-droplet jetting apparatus according to claim 20, wherein the liquid is an ink; the head includes a vibration plate which is arranged between the channel unit and the piezoelectric material layer; and the liquid chamber includes a plurality of pressure chambers.

22. The liquid-droplet jetting apparatus according to claim 20, wherein a slit which partitions the first portion and the second portion from each other is formed in the piezoelectric material layer.

23. The liquid-droplet jetting apparatus according to claim 20, wherein a groove which partitions the first portion and the second portion is formed in the piezoelectric material layer.

* * * * *